US008087105B2

(12) United States Patent
Tang

(10) Patent No.: US 8,087,105 B2
(45) Date of Patent: Jan. 3, 2012

(54) STOOL FLUSH CONTROL DEVICE

(75) Inventor: Yi-Wen Tang, Taichung (TW)

(73) Assignee: Hold Well Industrial Co., Ltd, Xistun Dist., Taichung (TW)

( * ) Notice: Subject to any disclaimer, the term of this patent is extended or adjusted under 35 U.S.C. 154(b) by 277 days.

(21) Appl. No.: 12/623,451

(22) Filed: Nov. 23, 2009

(65) Prior Publication Data

US 2011/0119822 A1 May 26, 2011

(51) Int. Cl.
*E03D 1/14* (2006.01)

(52) U.S. Cl. ..... 4/324; 4/415

(58) Field of Classification Search ..... 4/324, 325, 4/415

See application file for complete search history.

(56) References Cited

U.S. PATENT DOCUMENTS 5,325,547 A * 7/1994 Pino ..... 4/378
6,829,787 B1 * 12/2004 Pipenburg ..... 4/393
6,910,232 B2 * 6/2005 Antunez ..... 4/378

* cited by examiner

*Primary Examiner* — Huyen Le

(57) ABSTRACT

The present invention discloses a stool flush control device, which comprises a main pipe, an independent casing pipe, an indirect connecting pipe, a lock ring and a valve assembly. The main pipe includes flow passage, inclined kerf and screw-thread section. The casing pipe has penetrating hole, a plurality of hollow-out holes, U-shaped tying collar, and two flat kerfs. The lock ring is screw-coupled with the screw-thread section of the main pipe so as to fix in water reservoir tank. The valve assembly connects top flat kerf of the casing pipe. The tying collar ties the manifold. The top of the indirect pipe connects the casing pipe, and the bottom has an inclined opening couplably connecting the inclined kerf of the main pipe. A bolt and a nut are tightened together to press the tying collar so that the valve assembly, the casing pipe, the indirect pipe and the main pipe are closely couple-connected. Thus, the stool flush control device can be easily dismounted and mounted, and fit different sizes of assembly components.

6 Claims, 12 Drawing Sheets

STOOL FLUSH CONTROL DEVICE

FIELD OF THE INVENTION

The present invention relates to a stool flush control device, and more in particular to a stool flush control device which can be easily mounted or dismounted, and fits different sizes of assembly components.

BACKGROUND OF THE INVENTION

A conventional stool flush control device 80, as shown in FIGS. 14 and 15, mounted to the bottom inside the water reservoir tank of the stool, comprises a main pipe 81, a stopper body 82, and a lock ring 83, wherein a screw-thread section 811 disposed on the outer periphery of the lower section of the main pipe 81, a longitudinally penetrating flow passage 812 disposed in the interior of the main pipe 81, an upward extending manifold 813 connected on one side near the top of the main pipe, the manifold 813 being through with the flow passage 12, the stopper 82 covering the top of the flow passage 812, and through a connecting bar 821 pivotably connected to the lower section of the manifold 813, the lock ring 83 having inner screw-threads, the lower section of the main pipe 81 downward passing through from the bottom of the water reservoir tank, by means of the lock ring 83 threw-coupled to the screw-thread section 811 and hooking up the outer bottom of the water reservoir tank, the flush control device 80 fixedly disposed inside the water reservoir tank. The actuation principle of above-mentioned conventional flush control device 80 is: when the stopper 82 is pulled up, the flow passage 812 is opened, and the water will flow out. However, the conventional flush control device 80 has two disadvantages: a) the water outflow of the flow passage 812 cannot be controlled. It causes a waste; b) if any of the components of the flush control device 80 is damaged, and needs replacement, it is less convenient for dismounting or mounting because the lock ring lockably hoops up the outer bottom of the water reservoir tank.

Another conventional stool flush control device 90, as shown in FIGS. 16 and 17, comprising: one main pipe 91, one valve assembly 92 and one lock ring 94, wherein the top of the main pipe 91 integrally extending to form a connecting ring 911, a screw-thread section 912 disposed on the outer periphery of the lower section of the main pipe 91, the main pipe 91 having an inlet 913; a control device disposed in the valve assembly 92 and controlling the valve-controlling member 93 on vertical movement so as to close or open the inlet 913, a plurality of the raised portions 921 disposed on the outer periphery of the lower section of the valve assembly 92, the raised portions 921 inlaid in the L-shaped tank 914 of the inner wall of the connecting ring 911 so that the valve assembly 92 being through with the main pipe 91; the lock ring 94 having inner threads, two washers 95 and 96, sleeved over the main pipe 91, the lower section of the main pipe 91 downward passing through from the water reservoir tank, by means of the lock ring 94, screw-coupled to the screw-thread section 912 of the main pipe 91, and hooking up the outer bottom of the water reservoir tank so that the flush control device 90 fixedly disposed inside the water reservoir tank. The above-mentioned conventional flush control device 90 can control the water outflow by means of the distance and the duration which the valve member 93 travels so as to achieve water saving. The easily damaged components inside the valve assembly and the damaged valve can be easily maintained by replacing the valve assembly. However, this conventional flush control device 90 is not interchangeable with above mentioned first conventional flush control device 80. If the user who uses the first conventional flush control device wants to replace with the second flush control device 90, he has to dismount the whole flush control device 80, and buy a complete set of flush control device 90 because the second conventional flush control device cannot fit the components of the first conventional flush control device. It causes an unnecessary waste.

SUMMARY OF THE INVENTION

The major object of the present invention is to provide a stool flush structure which can be dismounted from or mounted to the original old model or new model of the flush structure of the stool at home. Its technical method comprises: one main pipe, one independent casing pipe, one indirect connecting pipe, one lock ring and one valve assembly; the interior of the main pipe being a longitudinally-through flow passage, the top of the main pipe being in form of a slanted opening, a screw-thread section disposed on outer periphery of the lower end; the interior of the casing pipe being an longitudinal through-hole, a plurality of hollow-out holes disposed on the periphery of the casing pipe, the top of the casing pipe being a first flat kerf, the bottom of the casing pipe being a second flat kerf; the lock ring screw-coupled to the screw-thread section of the main pipe so that the main pipe is secured to the water reservoir tank; the bottom of the valve assembly connected to the first flat kerf on top of the casing pipe; one lateral side of the casing pipe connected to one U-shaped tying collar which ties the manifold; the indirect connecting pipe being elastic and hollow, the top of the indirect connecting pipe connected to the connecting pipe, the bottom being a slanted opening which matches the inclined kerf of the main pipe, the slanted opening coupled to the inclined kerf of the main pipe; one bolt going through the two ends of the tying collar of the casing pipe, one nut screw-locked the end of the bolt, the valve assembly, the casing pipe, the indirect pipe and the main pipe closely couple-connected in sequence when the bolt and the nut are screw-tighten and press the tying collar.

DETAILED DESCRIPTION OF THE PREFERRED EMBODIMENT

Figure 1:
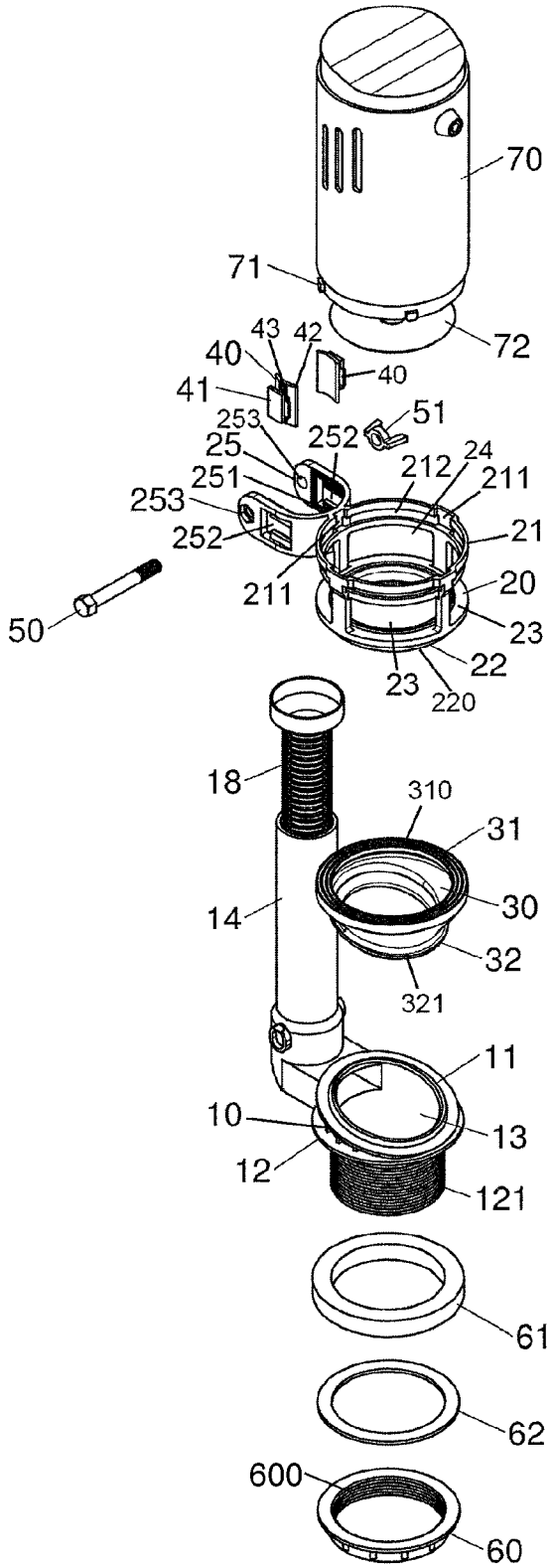
FIG. 1 is a three-dimensional exploded view in accordance with the present invention.

Referring to FIG. 1, the stool flush control device of the present invention basically comprising: one main pipe 10, one independent casing pipe 20, one indirect pipe 30, two slides 40, one bolt 50, one lock ring 60 and one valve assembly 70. The above-mentioned components are described as in the following.

Figure 11:
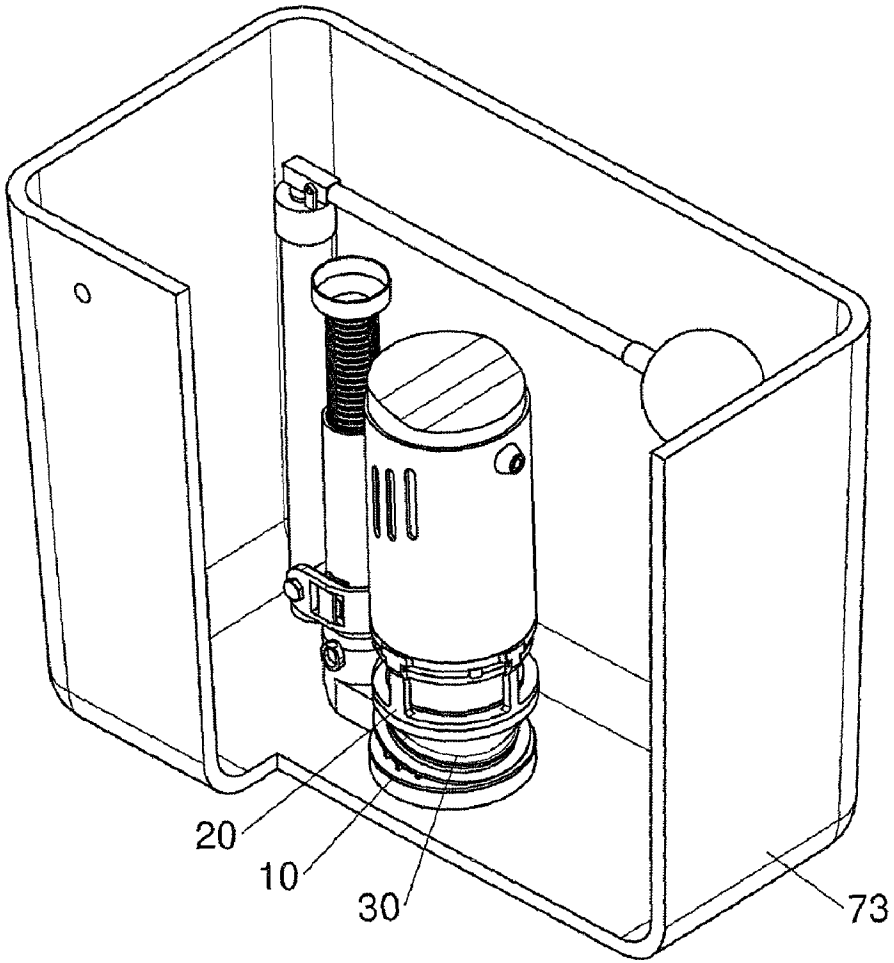
FIG. 11 is an assembly schematic view showing the device mounted in the water reservoir tank in accordance with the present invention.

Referring to FIGS. 1 and 11, the main pipe 10 is mounted in the water reservoir tank 73 of the stool, the interior of the main pipe 10 has a longitudinally-through flow passage 13, the top end of flow passage 13 of the main pipe 10 has an inclined kerf 11, a screw-thread section 12 is disposed on the outer periphery of the bottom of the main pipe 10, one upward extending manifold 14 connects to a lateral side of the main pipe 10 and through with the flow passage 13, the top portion of the manifold 14 connected one regulating pipe 18 which is relatively retractable to the manifold 14.

Figure 2:
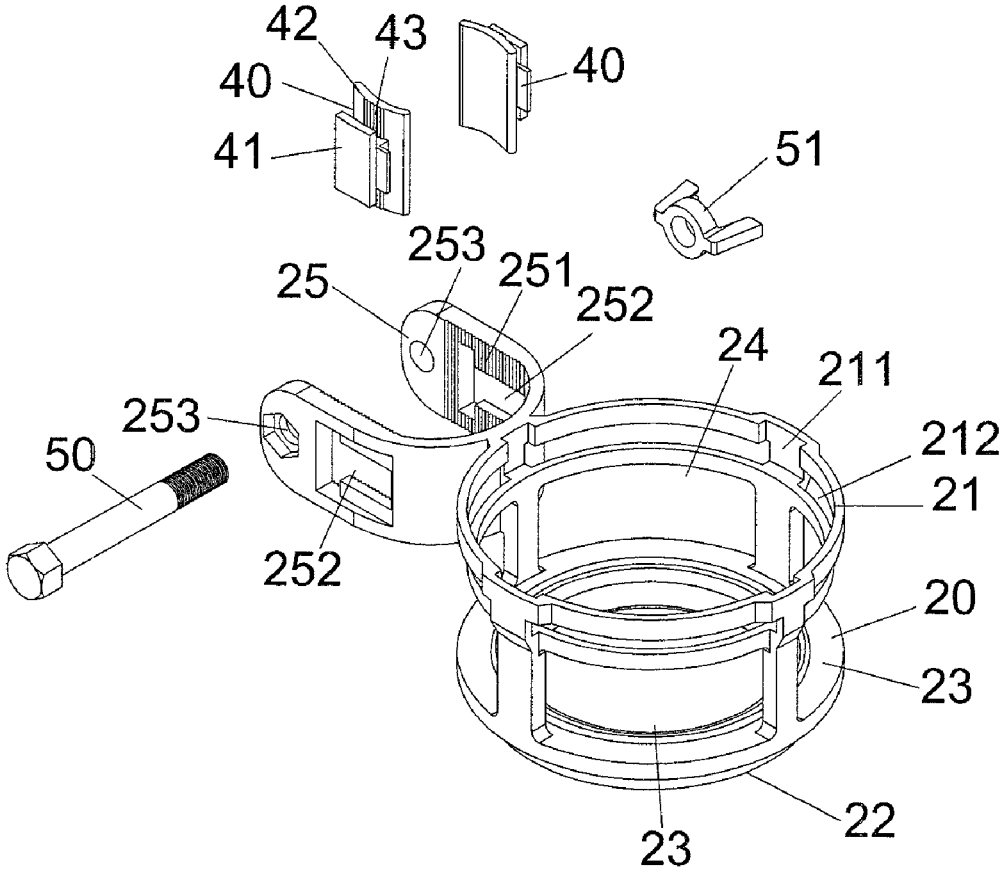
FIG. 2 is an enlarging three-dimensional view of the casing pipe in accordance with the present invention.
Figure 4:
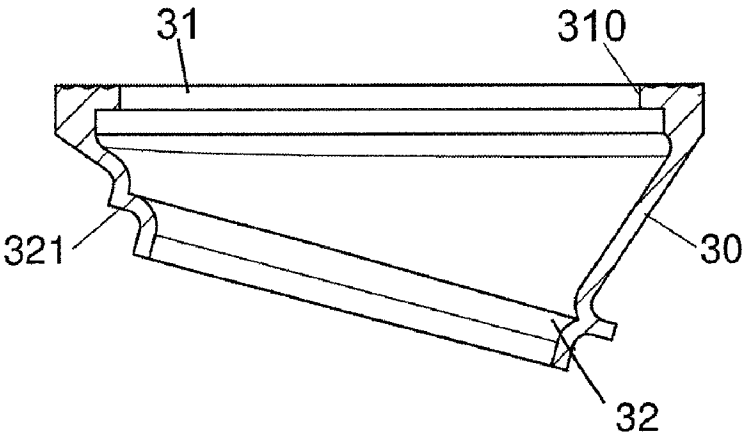
FIG. 4 is a cross-sectional view taken along line A-A in FIG. 3.
Figure 3:
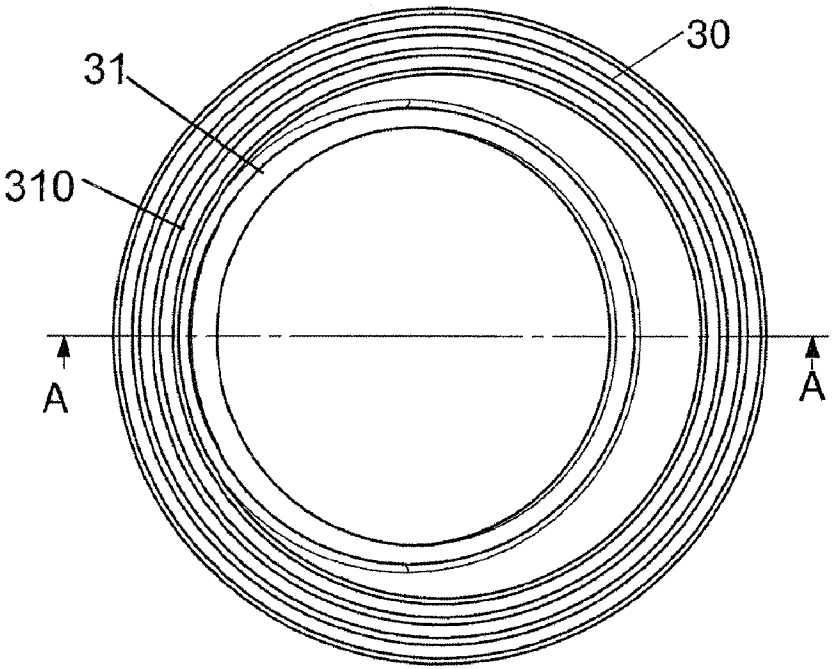
FIG. 3 is a top plan view of the indirect pipe in accordance with the present invention.

Referring to FIGS. 1 and 2, the interior of the casing pipe 20 has a longitudinally extending flow passage 24, a plurality of hollow-out holes 23 is disposed on the periphery of the casing pipe 20, a first flat kerf 21 is disposed on the top end of the casing pipe 20, a plurality of longitudinally extending slots 211 is disposed on the first flat kerf 21, the top end of each slot 211 is in form of an opening, and one lateral side of the bottom end of each slot 211 is connected a roundly extending arc slot 212, the arc slot 212 is roundly extending along the center axis of the casing pipe 20, the bottom of the casing pipe 20 has a second flat kerf 22, sunken rim 220 being annularly disposed on the outer wall of the second flat kerf 22, the outer periphery of the casing pipe 20 connecting a U-shaped tying collar 25 which is provided for tying the manifold 14, a plurality of raised column teeth 251 is disposed on the inner wall of the tying collar 25, two end sections of the tying collar 25 each is provided a slide slots 252 and a penetrating holes 253 therewith respectively.

Figure 7:
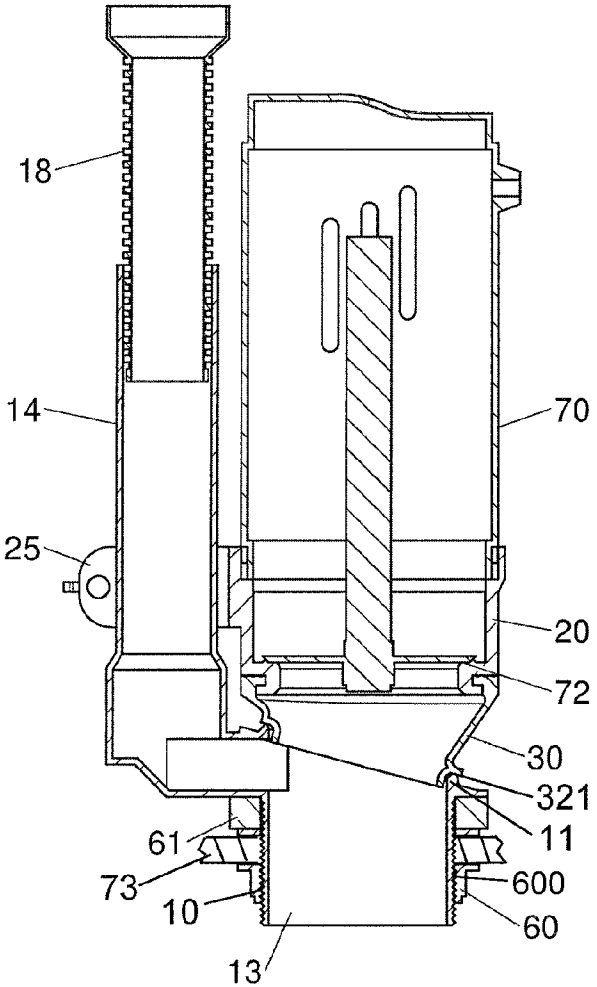
FIG. 7 is a cross-sectional view taken along line A-A in FIG. 6.
Figure 6:
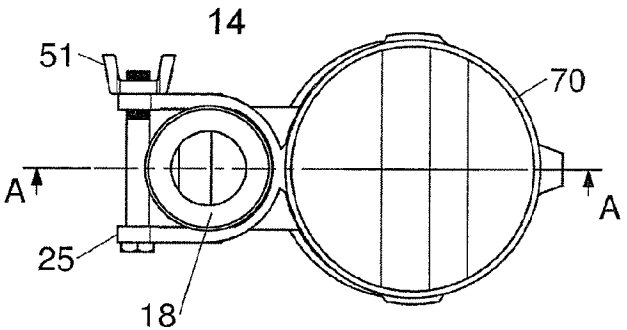
FIG. 6 is a top plan view in according with the present invention.
Figure 9:
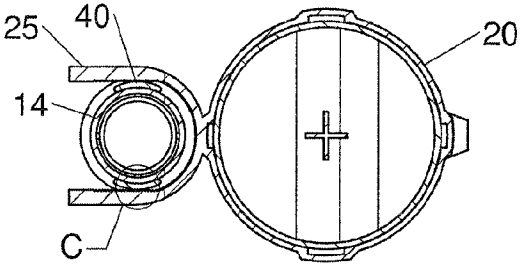
FIG. 9 is a cross-sectional view taken along line B-B in FIG. 8.
Figure 10:
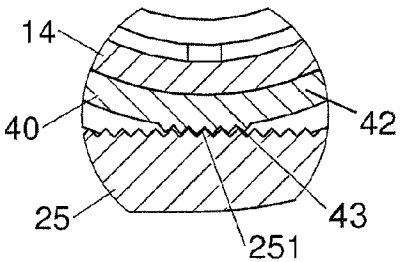
FIG. 10 is an enlarged view taken along Circle C in FIG. 9.
Figure 8:
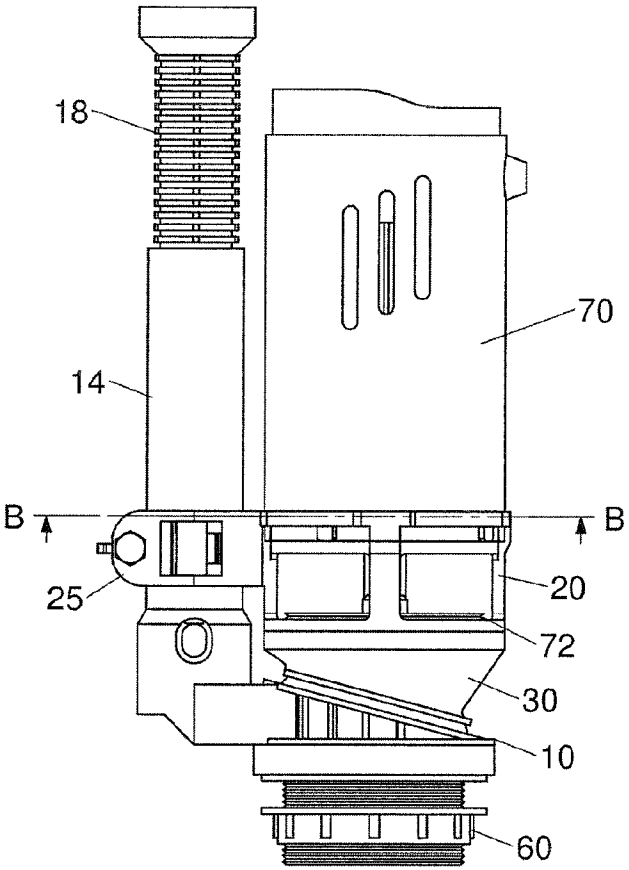
FIG. 8 is the front view in accordance with the present invention.

Referring to FIGS. 1, 3, 4 and 7, the indirect pipe 30 is elastic and hollow, the top end of the indirect pipe has a flat opening 31, a flange 310 annularly is disposed on the inner wall of the flat opening 31, the flange 310 of the indirect pipe 30 is inlaid in the sunken rim 220 of the casing pipe 20 so that the top of the indirect pipe 30 connects the casing pipe 20 as shown in FIG. 7, a inclined opening 32 is disposed on the bottom end of the indirect pipe 30 and matching the inclined kerf 11 of the main pipe 10, the indirect pipe 30 connects the main pipe 10 when the inclined opening 32 is coupled to the inclined kerf 11. Referring to the illustrated embodiment, a sunken slot 321 annularly disposed on the outer wall of the inclined opening 32, the end portion of the inclined kerf 11 inlaid in the sunken slot 321 so that the bottom of the indirect pipe 30 connects the main pipe 10 as FIG. 7 shown.

Referring to FIGS. 1, 2, 5 and 7, the two slides 40 are slidably inlaid in the two slide slots 252 of the tying collar 25 respectively, one outer-diameter-enlarging retaining plate 41 and one outer-diameter-enlarging arc plate 42 are respectively disposed at two ends of each slide 40, the retaining plate 41 retainably is disposed on one lateral side of the slide slot 252, a front surface of the arc plate 42 is in form of arc and contactably disposed on the outer periphery of the manifold 14, a plurality of retaining teeth 42 disposed on the surface of a back side of the plate body 42, the retaining teeth 42 is engaged with the raised teeth 251 of the tying collar 25. The bolt 50 goes through the two penetrating holes 253 of the two end sections of the tying collar 25, a nut 51 screw-tightened the end section of the bolt 50, the nut 51 locks the bolt 50 to press the tying collar 25 so that the two slides 40 clamp the manifold 14, and the casing pipe 20, the indirect pipe 30 and the main pipe 10 are closely couple-connected in sequence.

Referring to FIG. 7, threads 600 disposed on the inner wall of the lock ring 60, the threads 600 screw-connected to the screw-thread section 121 of the main pipe 10, a hard retaining ring 62 and a soft-and-elastic sealing ring 61 are sleeved over the main pipe 10 and disposed on the top of the locking ring 60 in sequence, the lock ring 60 at the outer bottom of the stool water reservoir tank 73 screw-coupled to the screw-thread section 12 so that the main pipe 10 is secured to the stool water reservoir tank 73.

Figure 5:
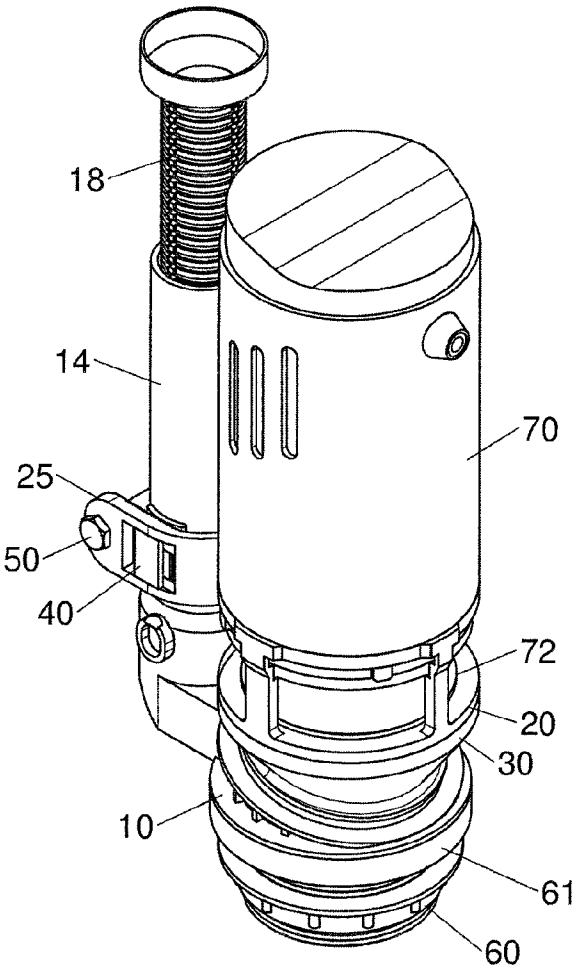
FIG. 5 is a three-dimensional assembly view in accordance with the present invention.

Referring to FIGS. 1, 2 and 5, a plurality of retaining portions 71 is raisedly disposed on the outer periphery of the bottom end of the valve assembly 70, the retaining portion 71 from the slot 211 of the casing pipe 20 rotatably inlaid in the roundly extending arc slot 212 to form a retention so that the valve assembly 70 connects the casing pipe 20, a sealing element 72 disposed in the valve assembly 70, the sealing element 72 sealing the flow passage 24 of the casing pipe 20.

Referring to FIGS. 2, 8 through 11, the two sliding members 40 are contactably disposed on the outer periphery of the manifold 14 of the main pipe 10, the retaining plate 41 and the arc plate 42 are respectively disposed on two sides 252 of the slide slot 252 so that the sliding member 40 is slidably disposed in the slide slot 252 of the casing pipe 20, the retaining teeth 43 engaged with the raised teeth 251 on the casing pipe 20, the tying collar 25 being compressed and tied by the bolt so that the two slides 40 at the two end sections of the tying collar 25 clamp the manifold 14, and the main pipe 10, the indirect pipe 30, the casing pipe 20 as well as the valve assembly 70 are stably connected together.

Figure 12:
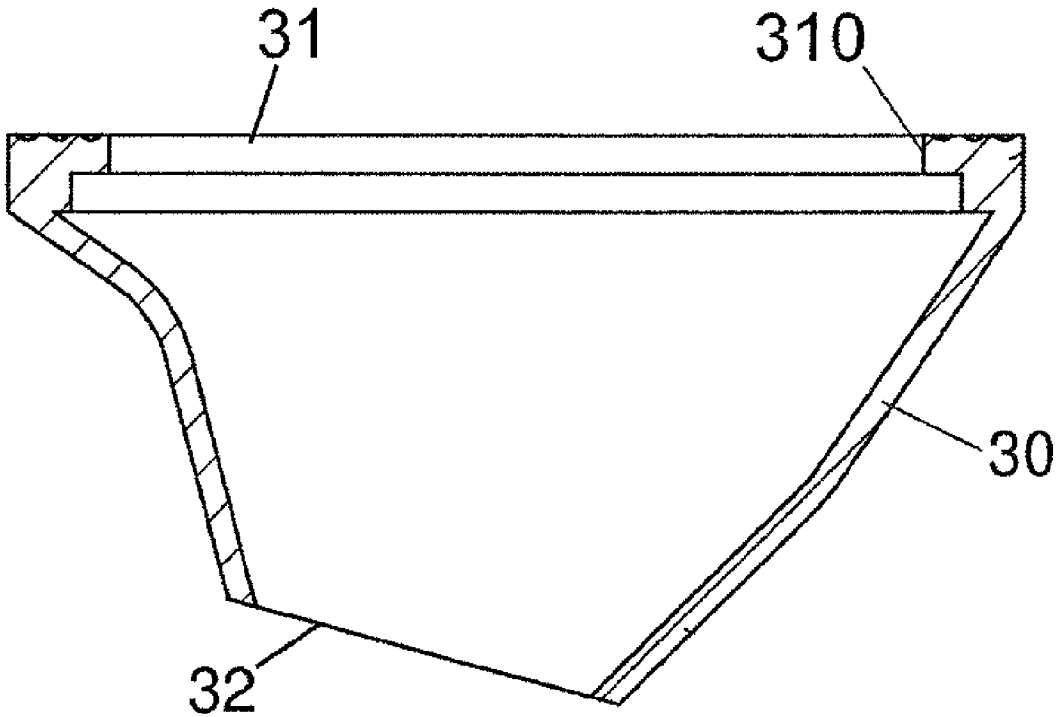
FIG. 12 is a sectional view of the indirect pipe of the second embodiment in accordance with the present invention.

Referring to FIG. 12, it is the second embodiment of the indirect pipe 30, the inclined opening 32 on the bottom of the indirect pipe 30 is in a funnel shape, and partially directly going through the interior of the inclined kerf 11 of the main pipe 10 so that the indirect pipe 30 connects the main pipe 10. Therefore the indirect pipe 30 can fit different sizes of the main pipe 10.

Figure 13:
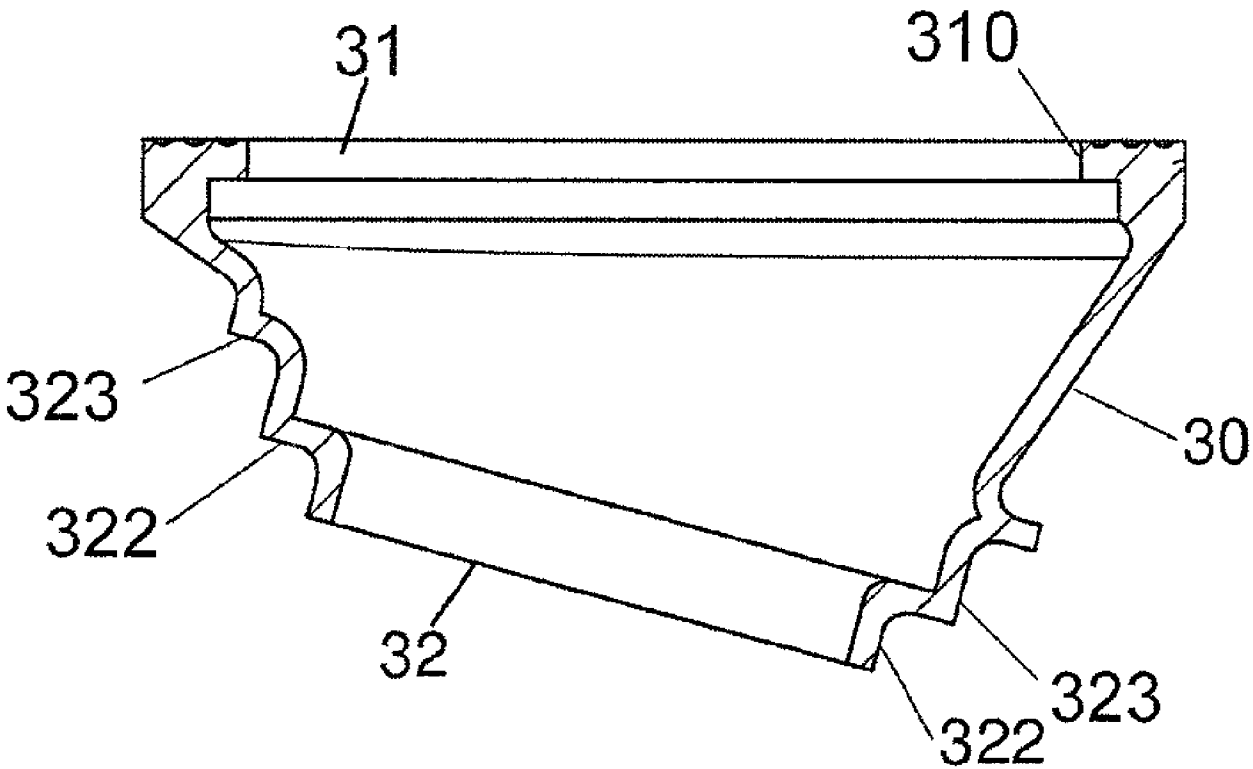
FIG. 13 is a sectional view of the indirect pipe of the third embodiment in accordance with the present invention.
Figure 15:
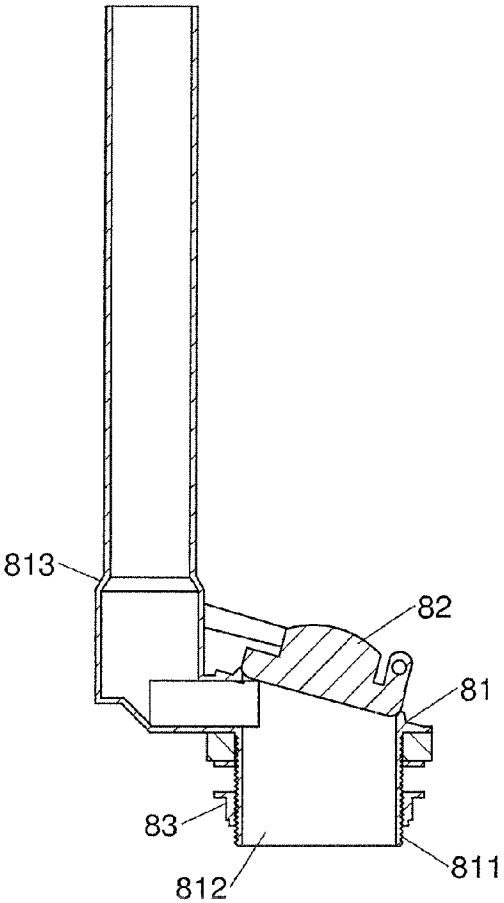
PRIOR ART FIG. 15
FIG. 15 is a cross-sectional view taken along line A-A in FIG. 14.
Figure 14:
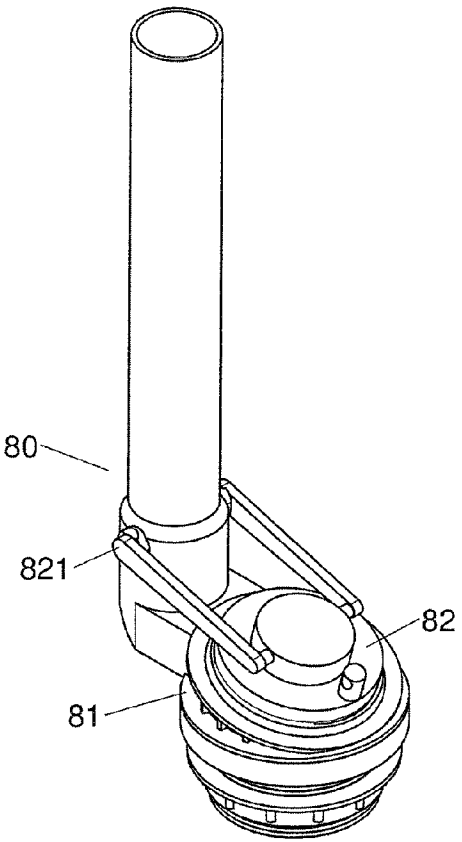
PRIOR ART FIG. 14
FIG. 14 is a three-dimensional view of the flush control device in accordance with a first prior art.
Figure 16:
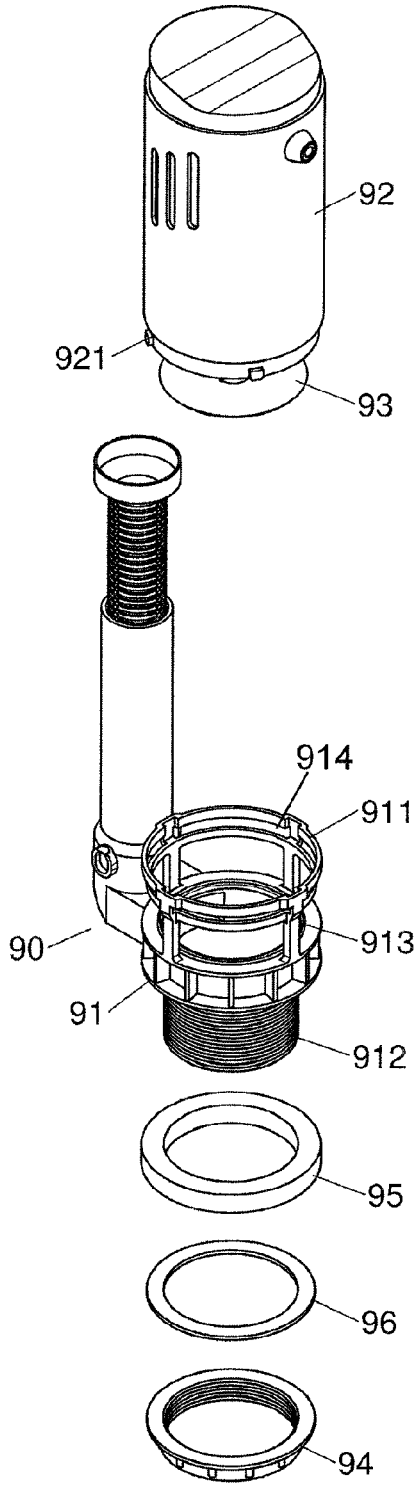
PRIOR ART FIG. 16
FIG. 16 is a three-dimensional exploded view of the flush control device in accordance with a second prior art.
Figure 17:
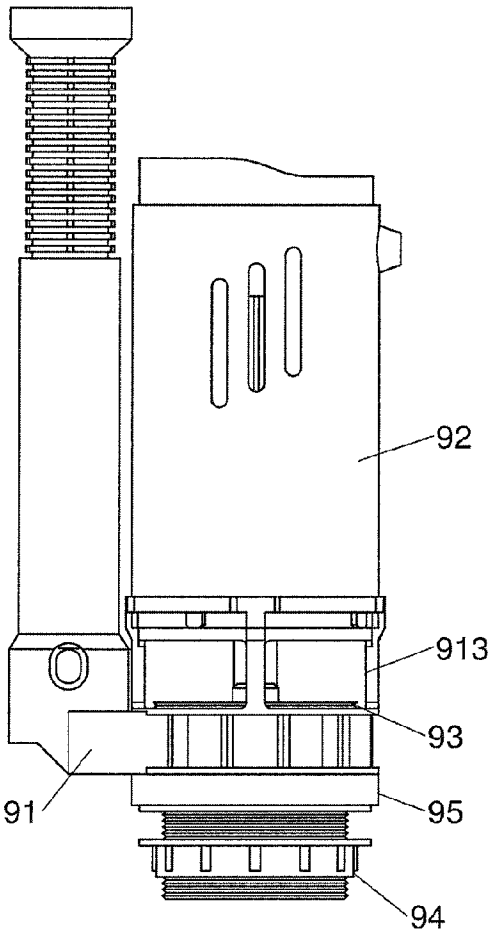
PRIOR ART FIG. 17
FIG. 17 is a plane side view of the flush control device in accordance with the second prior art.

Referring to FIG. 13, it is the sectional view of the indirect pipe 30 of the third embodiment in accordance with the present invention, wherein the two consecutive ladders 322/323 disposed on the outer wall of the inclined opening 32 of the indirect pipe 30, the two ladders 322/323 being able to couplably inlay with the inclined kerfs 11 of different pipe bodies 10 respectively. Therefore, the indirect pipe 30 can fits two different sizes of the pipe bodies.

The advantages of the present invention are shown below:

1. The casing pipe 20 of the present invention is an independent body. The casing pipe incorporated with the indirect pipe 30 fits many different sizes of assembly components.

2. The whole components of the present invention are integrally designed. It is very simple and easy to mount and dismount the components. The user himself can easily replace the components.

3. A tying collar is disposed on one lateral side of the casing pipe of the present invention. The tying collar not only assists fixation that the whole assembled components become more stable after assembling, but also has movable slides to adjust the tying position to match different diameters of the manifolds. Thus, the applicability is increased, and the stability of assembly is boosted.

While we have shown and described the embodiment in accordance with the present invention, it should be clear to those skilled in the art that further embodiments may be made without departing from the scope of the present invention.

What is claimed is:

1. A stool flush control device comprising a main pipe, a casing pipe, a lock ring and a valve assembly; the main pipe being disposed in a water reservoir tank, the interior of the main pipe being a longitudinally-through flow passage, a inclined kerf disposed on the top end of the main pipe, a screw-thread section being disposed on the outer periphery of the bottom of the main pipe, an upward extending manifold being through with the flow passage and disposed on a lateral side of the main pipe; the interior of the casing pipe being a longitudinally-through flow passage, a plurality of hollow-out holes disposed on the periphery of the casing pipe, a first flat kerf being disposed on the top end of the casing pipe, a second flat kerf being disposed on the bottom of the casing pipe; threads being disposed on the inner wall of the lock ring, the lock ring being positioned at the outer bottom of the water reservoir tank and screw-coupled to the screw-thread section of the main pipe so that the main pipe being secured to the water reservoir tank; the bottom end of the valve assembly connecting the first flat kerf of the casing pipe, a sealing element disposed in the valve assembly to controllably seal the flow passage of the casing pipe;

Wherein:

the outer periphery of the casing pipe connecting an U-shaped tying collar which is used to tie the manifold, a plurality of raised column teeth being disposed on the inner wall of the tying collar, two end sections of the tying collar each having a slide slot and a penetrating hole respectively; the bottom end of the casing pipe connecting an indirect pipe which is hollow and elastic, a flat opening being disposed on the top end of the indirect pipe, a flange annularly being disposed on the inner wall of the flat opening of the indirect pipe, the flange being inlaid in a sunken rim which is provided on the outer periphery of the second flat kerf of the casing pipe so that the top end of the indirect pipe connecting the casing pipe, the bottom end of the indirect pipe being a inclined opening which matches the inclined kerf of the main pipe, the inclined opening of the indirect pipe being couplably connected to the inclined kerf of the main pipe; a sliding member inlaid in the slide slot of the tying collar, an outer-diameter-enlarging retaining plate and a plate body disposed at two ends of the sliding member respectively, the retaining plate retained on an outer side of the slide slot, a front side of the plate body in form of arc and being contactably disposed on the outer periphery of the manifold, a plurality of retaining teeth being disposed on the surface of a back side of the plate body, the retaining teeth engaged with the raised column teeth of the tying collar; a bolt being disposed in the penetrating holes of the two end sections of the tying collar, a nut being screw-tightened an end section of the bolt, the bolt and the nut being tightly locked together to press the tying collar so that the slide member clamping the manifold, and the casing pipe, the indirect pipe and the main pipe closely couple-connected in sequence.

2. The stool flush control device as claimed in claim 1, wherein a plurality of longitudinally extending slots are disposed on the inner wall of the first flat kerf of the casing pipe, the top end of each slot is in form of an opening, and a lateral side of the bottom end of each slot is connected a roundly extending arc slot, a plurality of retaining portions are raisedly disposed on outer side of the bottom of the valve assembly, and the retaining portion is inlaid in the slot of the casing pipe and rotates in the arc slot to form retention so that the valve assembly connects the casing pipe.

3. The stool flush control device as claimed in claim 1, wherein the retaining ring is a hard material, and the sealing ring is a soft material with elasticity.

4. The stool flush control device as claimed in claim 1, wherein a regulating pipe connects the top of the manifold, and the regulating pipe is retractable relatively to the manifold.

5. The stool flush control device as claimed in claim 1, wherein a sunken slot is annularly disposed on the outer wall of the inclined opening of the indirect pipe, the end portion of the inclined kerf of the main pipe is inlaid in the sunken slot so that the indirect pipe and the main pipe are connected together.

6. The stool flush control device as claimed in claim 1, wherein two consecutive ladders are disposed on the outer wall of the inclined kerf of the indirect pipe.

* * * * *